US005265798A

United States Patent [19]

DeMaio et al.

[11] Patent Number: 5,265,798

[45] Date of Patent: Nov. 30, 1993

[54] TUBULAR BEVERAGE CARTON WITH FLAP ALIGNMENT FEATURE

[75] Inventors: James B. DeMaio, Marietta; James T. Stout, Ellijay, both of Ga.

[73] Assignee: The Mead Corporation, Dayton, Ohio

[21] Appl. No.: 856,594

[22] Filed: Mar. 24, 1992

[51] Int. Cl.[5] ..... B65D 5/42

[52] U.S. Cl. ..... 229/132; 229/137; 229/900

[58] Field of Search ..... 229/40, 132, 137, 138, 229/900; 206/427

[56] References Cited

U.S. PATENT DOCUMENTS

| | | | |
|---|---|---|---|
| 1,921,150 | 8/1933 | Bomberger | 229/132 |
| 1,987,647 | 1/1935 | Wellman | 229/137 |
| 2,553,803 | 5/1951 | Zinn, Jr. | 229/137 |
| 2,670,128 | 2/1954 | Stowitts | 229/132 |
| 2,939,625 | 6/1960 | Synder . | |
| 2,962,202 | 11/1960 | Hansen | 229/132 |
| 3,035,750 | 5/1962 | Kauffeld | 229/137 |
| 3,194,474 | 7/1965 | Rumberger | 229/132 |
| 3,232,515 | 2/1966 | Saidel | 229/132 |
| 3,746,243 | 7/1973 | Young | 229/132 |
| 4,141,485 | 2/1979 | Lambert | 229/132 |

FOREIGN PATENT DOCUMENTS

| | | | |
|---|---|---|---|
| 1184175 | 3/1970 | United Kingdom | 229/132 |
| 1405596 | 9/1975 | United Kingdom | 229/132 |

*Primary Examiner*—Gary E. Elkins

*Attorney, Agent, or Firm*—Thomas A. Boshinski

[57] ABSTRACT

A tubular carton includes interconnected bottom, side and top walls. The side walls are disposed perpendicular to the top and bottom walls to form a sleeve, with a dust flap foldably joined to each end of each of the top and bottom walls. An end flap is foldably joined to each end of the side walls, with at least a portion of each of the end flaps being disposed perpendicular to the major axis of the sleeve. An alignment edge is defined along each side edge of at least one of the dust flaps, the alignment edge being defined by a portion of the side edge extending to the fold line connecting an adjacent one of the end flaps to the respective one of the side walls. A corresponding carton blank is also disclosed.

3 Claims, 6 Drawing Sheets

TUBULAR BEVERAGE CARTON WITH FLAP ALIGNMENT FEATURE

BACKGROUND OF THE INVENTION

The present invention relates generally to tubular or sleeve style cartons used in the packaging of beverage containers such as aluminum cans. More particularly, the invention relates to an alignment means for the flaps used to close the ends of the tubular carton.

Tubular beverage cartons have been known for many years. An example is shown in U.S. Pat. No. 4,508,258, wherein a tubular carton includes top, bottom and side panels. At each end of the carton, dust flaps which partially close the carton end are connected along fold lines to the top and bottom panels. End closure panels are connected to the side panels and extend substantially the full height of the carton to close the carton end.

In order to improve the folding operation in closing the carton ends, it is common practice to remove some of the carton material along the side edges of the dust flaps and/or end flaps. In fact, U.S. Pat. No. 4,508,258 teaches the removal of greater material than normal in order to further enhance folding performance. At the same time, a problem exists in folding the end flaps in that, for various reasons including drag on the carton as it moves through erecting and loading machinery, the carton can become slightly skewed during the folding operation. Gluing of the flaps into a closed position then maintains the carton in an unwanted skewed condition.

The referenced U.S. Pat. No. 4,508,258 teaches that the removal of carton material from the upper and lower side edges of the end flaps will permit some degree of misalignment to occur without affecting the closing of the carton. However, such misalignment is still objectionable from an appearance standpoint, particularly where printing on the carton end requires text or graphic images which extend over the end flaps.

What is needed is an end-closure structure for a tubular beverage carton in which excess material does not interfere with the folding operation of the carton, but yet provides means for maintaining the carton in rectangular alignment.

SUMMARY OF THE INVENTION

Accordingly, the present invention provides a tubular carton comprising a bottom wall, a pair of side walls foldably joined to the bottom wall, a top wall foldably joined to the side walls, the side walls being disposed perpendicular to the top and bottom walls to form a sleeve, a dust flap foldably joined to each end of each of the top and bottom walls, and an end flap foldably joined to each end of the side walls. Each of the dust flaps and end flaps are disposed perpendicular to the major axis of the sleeve, with the end flaps overlying and secured to the dust flaps.

The improvement comprises an alignment edge defined along at least one side edge of at least one of the dust flaps, the alignment edge being defined by a portion of the side edge of the dust flap which extends along the fold line connecting the respective end of one of the side walls with the end flap connected thereto.

Similar alignment edges may be provided along both side edges of at least one dust flap, and similar alignment edges may be provided along more than one of the dust flaps.

The carton may further include web structure comprising at least one web panel foldably connected along a side edge of the dust flap and a side edge of an adjacent one of the end flaps.

The invention may further comprise a blank for a tubular carton comprising a top wall, a pair of side walls foldably joined to the side edges of the bottom wall, a pair of bottom wall panels foldably joined respectively to the side walls remote from the top wall, a dust flap foldably joined to each side edge of each of said top wall and bottom wall panels, and an end flap foldably joined to each side edge of said side walls. The improvement comprises an alignment edge defined along at least one side edge of at least one of the dust flaps, the alignment edge being defined by a portion of the side edge extending along an imaginary line coincidental with the respective fold line connecting the bottom wall or top wall panel to which the dust flap is connected with an adjacent one of the side walls.

BRIEF DESCRIPTION OF THE DRAWINGS

In order to better understand the invention, reference is now made to the accompanying drawings in which.

DETAILED DESCRIPTION OF THE PREFERRED EMBODIMENTS

Figure 1:
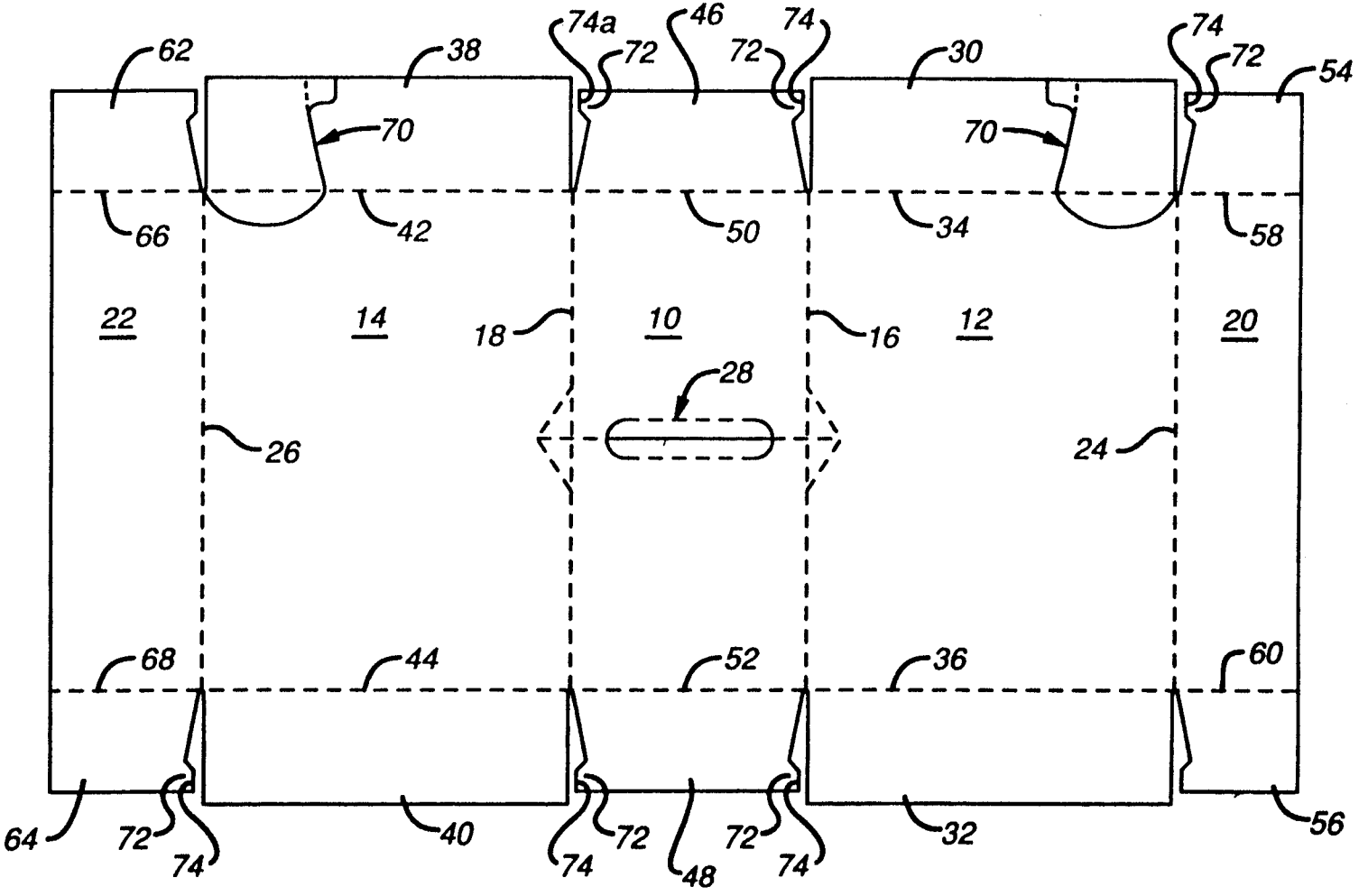
FIG. 1 is a plan view of a blank from which the tubular carton is formed according to this invention.

Referring now to FIG. 1, a blank for a tubular beverage carton is shown wherein the numeral 10 designates the top wall of the carton to the side edges of which side walls 12 and 14 are foldably joined along fold lines 16 and 18 respectively. The bottom wall of the carton is formed by a combination of bottom panels 20 and 22 which are foldably joined respectively to the upper edges of side walls 12 and 14 along fold lines 24 and 26. Carrying means is provided for the carton and is formed by handle structure 28 disposed in top wall 10 and portions of side walls 12 and 14. Handle structure 28 is described in detail in U.S. Pat. No. 4,558,816.

End closure structure, in part, is provided for the carton in the form of end flaps 30 and 32 which are foldably joined to the end edges of side wall 12 along fold lines 34 and 36 respectively. In addition, end flaps 38 and 40 are foldably joined to the end edges of side wall 14 along fold lines 42 and 44 respectively. In like fashion, dust flaps 46 and 48 are foldably joined to the end edges of top wall 10 along fold lines 50 and 52 respectively.

Additional end closure structure is provided in the form of partial dust flaps 54 and 56 which are foldably joined to the end edges of bottom panel 20 along fold lines 58 and 60 respectively. Likewise, partial dust flaps 62 and 64 are foldably joined to the end edges of top panel 22 along fold lines 66 and 68 respectively.

A roll-out dispenser feature 70 may be formed in end flaps 30 and 38 and portions of side walls 12 and 14. Such dispenser structures are well known in the art, with one example being shown in U.S. Pat. No. 4,364,509.

Figure 2:
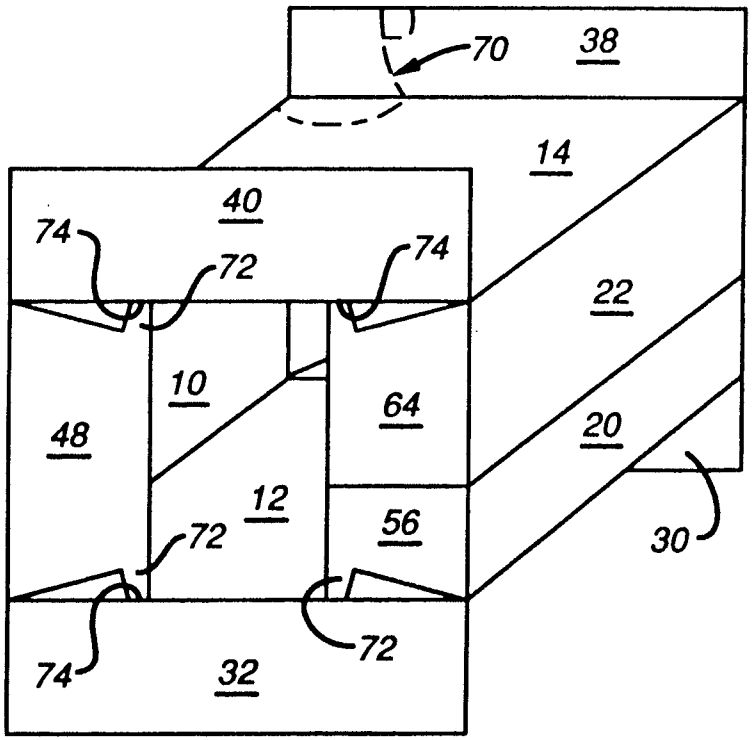
FIG. 2 is a perspective view of a partially erected carton, showing an intermediate stage through which the end closure structure of the carton is manipulated.

Referring now to FIG. 2, the carton formed from the blank of FIG. 1 is shown in a partially erected condition. As can be seen from FIG. 2, bottom panels 20 and 22 have been positioned with panel 22 overlapping panel 20, the panels being secured by glue to form a bottom wall. After the carton has been loaded with beverage cans (not shown), dust flaps 48 and 56, 64 are folded inwardly to the position shown in FIG. 2. It should be noted that each dust flap 48 and 56, 64 includes a projection 72 on each side edge of the dust flaps. Each projection 72 in turn defines an alignment edge 74 which is positioned, as seen in FIG. 2, adjacent the respective fold line 36 or 40 connecting the adjacent end flap 32 or 40 to the side wall 12 or 14. The alignment edges 74 act against the respective fold lines 36 and 44, particularly as the end flaps 32 and 40 are being moved to a closed position, to support the tubular carton and prevent skewing.

Figure 3:
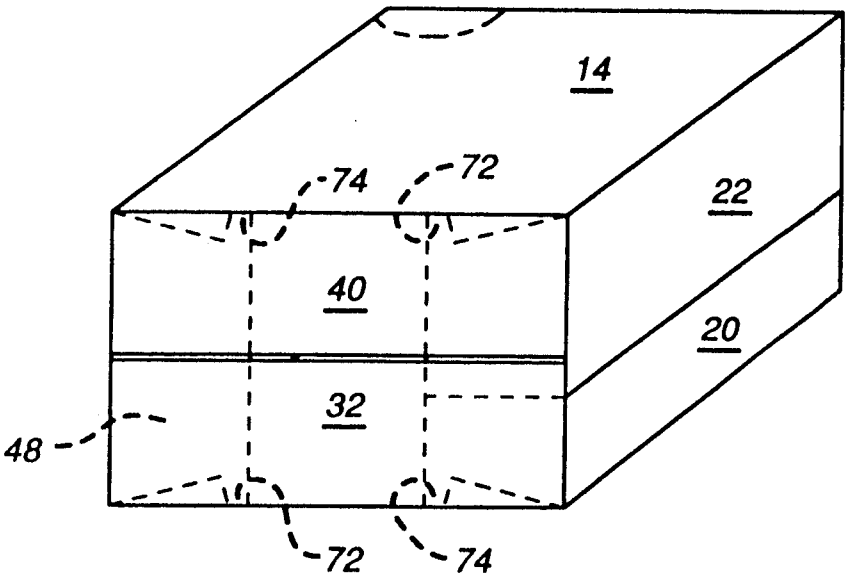
FIG. 3 is an end perspective view of a completed carton formed according to this invention.

The completed carton, with the dust flaps 48 and 56, 64 shown in phantom, may be seen by reference to FIG. 3.

Referring back to the blank shown in FIG. 1, it can also be seen that alignment edges 74 on projections 72 lie along an imaginary line coincidental with and extending from the fold line connecting the respective top wall 10 or bottom panel 20 and 22 with the corresponding side wall 12 or 14. For example, the alignment edge particularly denoted as 74*a* on dust flap 46 lies along an imaginary line extending from and coincidental with fold line 18.

Figure 4:
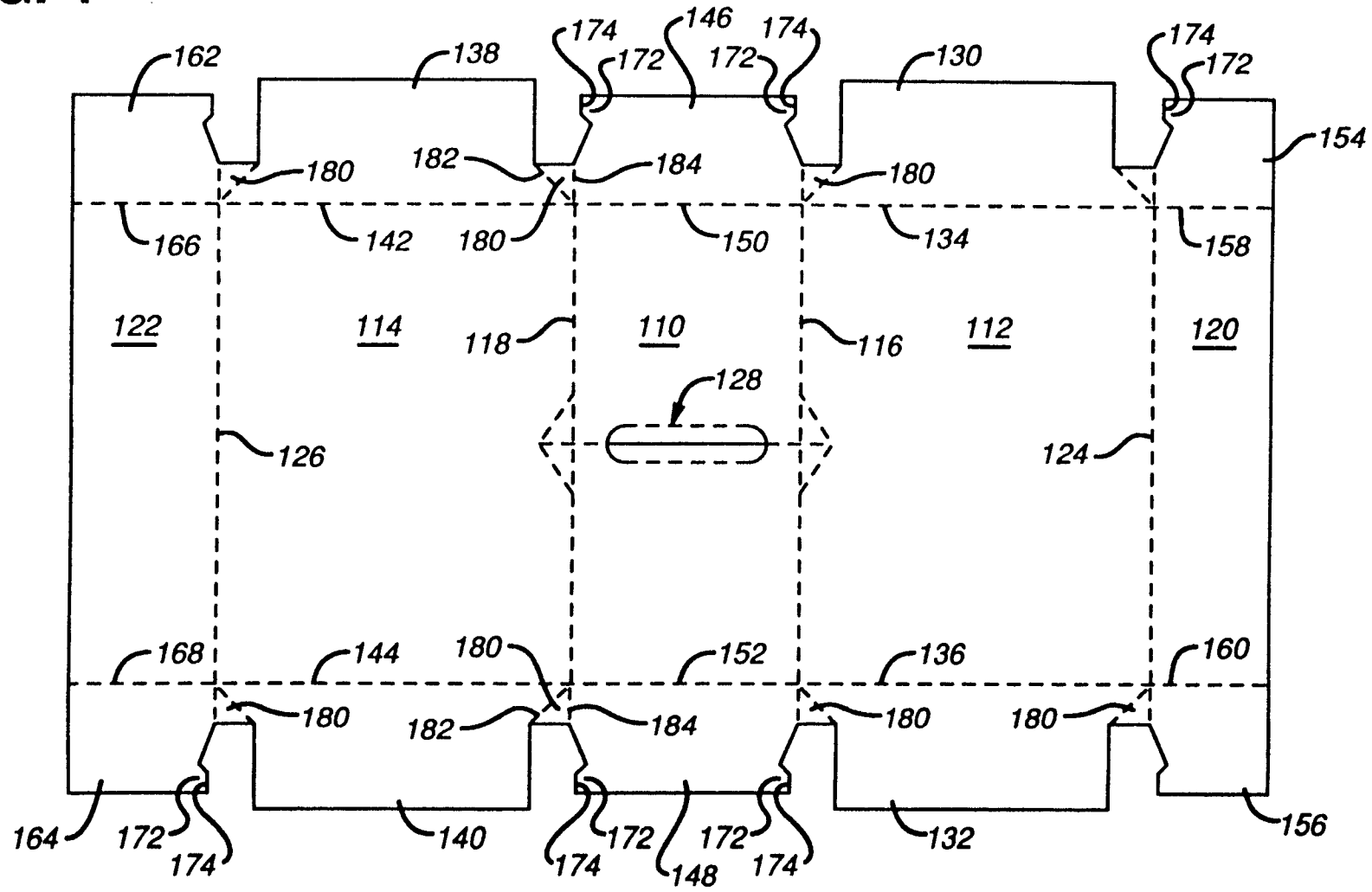
FIGS. 4–6 are views similar to FIGS. 1–3, respectively, showing an alternative embodiment for the present invention.
Figure 6:
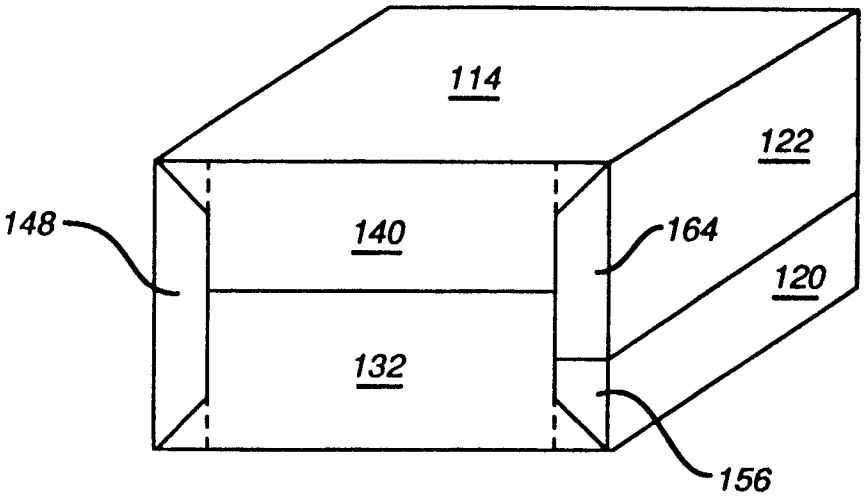
Figure 5:
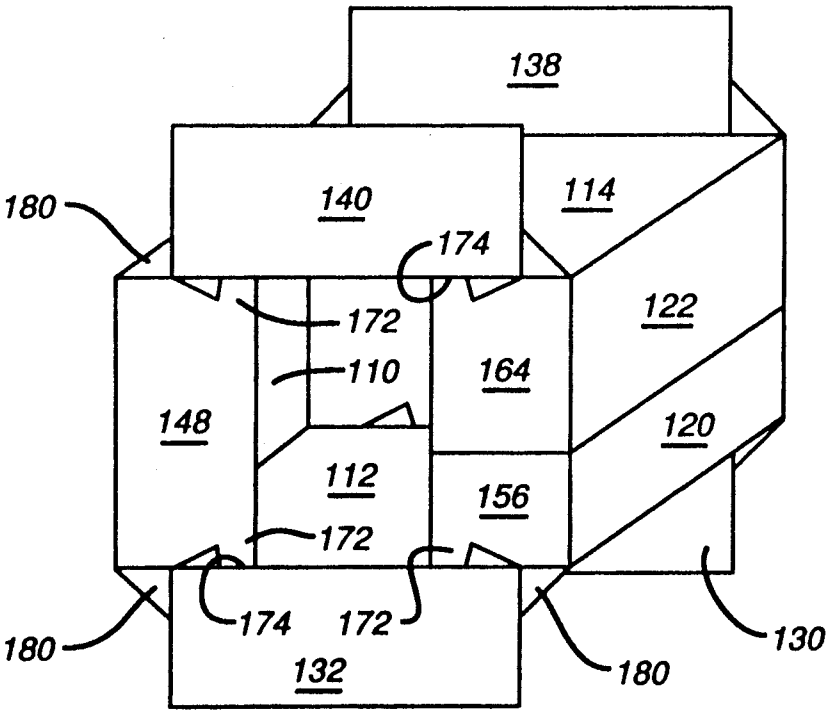

An alternate embodiment for the present invention is shown in FIGS. 4–6. The various parts of the tubular carton shown therein which correspond to the parts of the carton shown in FIGS. 1–3 are identified by reference numerals identical to the carton of FIGS. 1–3 but increased by 100. Thus, for example, top wall 110 corresponds to top wall 10, side walls 112 and 114 correspond to side walls 12 and 14, and so forth.

The embodiment of FIGS. 4–6 differs from the embodiment of FIGS. 1–3 in the addition of web structure comprising web panels 180 formed between each adjacent pair of dust flaps and end flaps. For example, a web panel 180 is formed between end flap 140 and dust flap 148, foldably connected to end panel 140 by a fold line 182, and foldably connected to dust flap 148 by a fold line 184. Such web panels aid in the folding of the end closure structure. Such web panel arrangements are known in the prior art and may be seen for example by reference to U.S. Pat. No. 4,216,861.

As seen in FIG. 5, reverse folding of the end flaps 132 and 140 causes at least partial closure of dust flaps 148 and 156, 164, with the further result that web panels 180 are folded to overlap a portion of the respective end flaps 132 and 140. Upon complete closure of the carton, as shown in FIG. 6, web panels 180 are positioned between the dust flap and end flap to which each particular web panel 180 is connected.

As also seen from FIG. 6, end flaps 132 and 140 are each formed having a height greater than the total height of the carton. As a result, upon closure of the end flaps 132 and 140, an overlapping of the end flaps occurs along their outer edge. The end flaps are secured to each other by gluing, with separate application of glue to the associated dust flaps not being necessary.

Importantly, the embodiment shown in FIGS. 4–6 includes the alignment projections 172 formed on each of the dust flaps 146, 148, 154, 162 and 156, 164. Each alignment projection 172 includes an alignment edge 174 formed substantially identical to and for the identical purposes as the alignment edges 74 in the embodiment of FIGS. 1–3.

Figure 7:
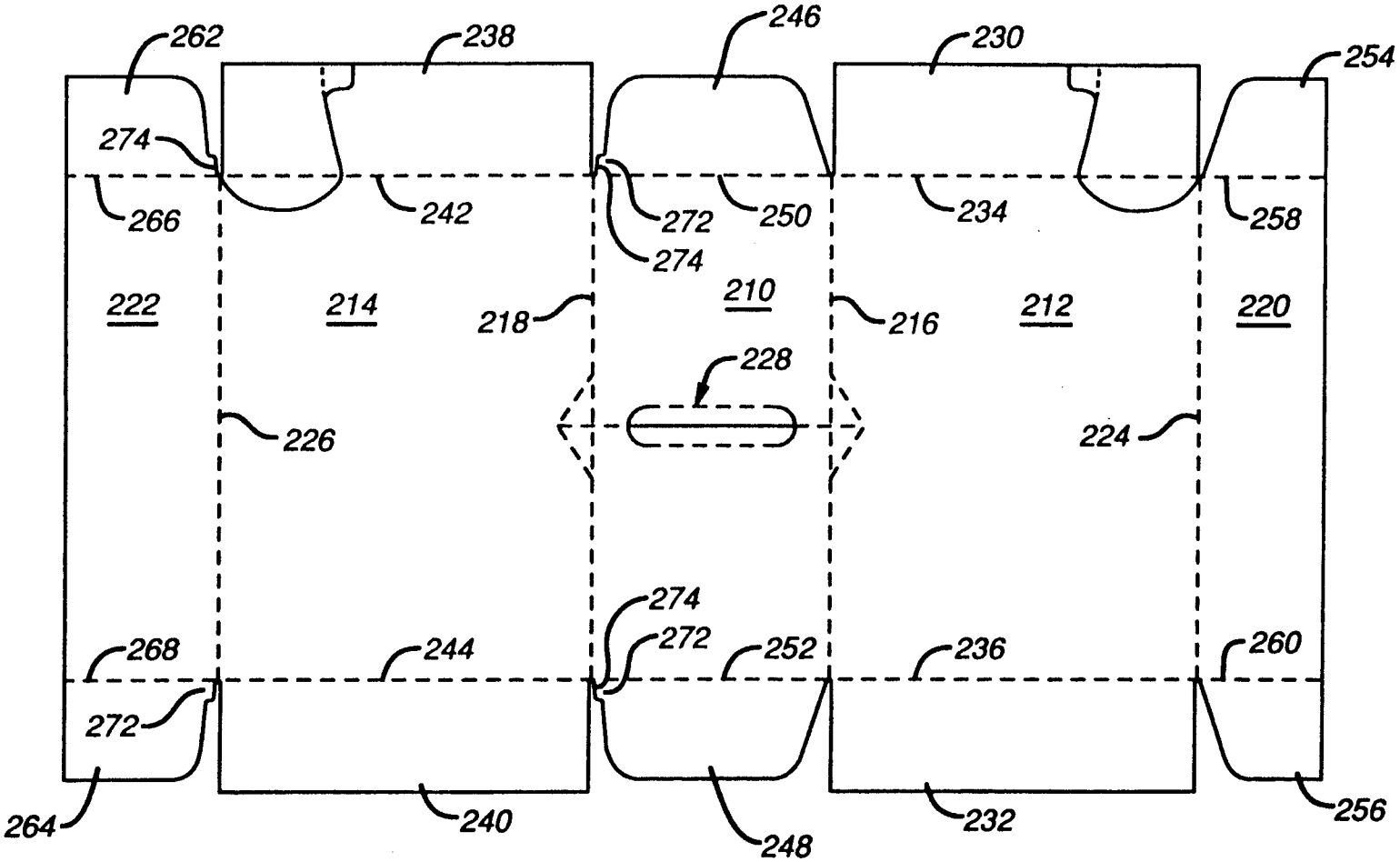
FIGS. 7–9 are views similar to FIGS. 1–3, respectively, showing a further alternative embodiment of the present invention.
Figure 9:
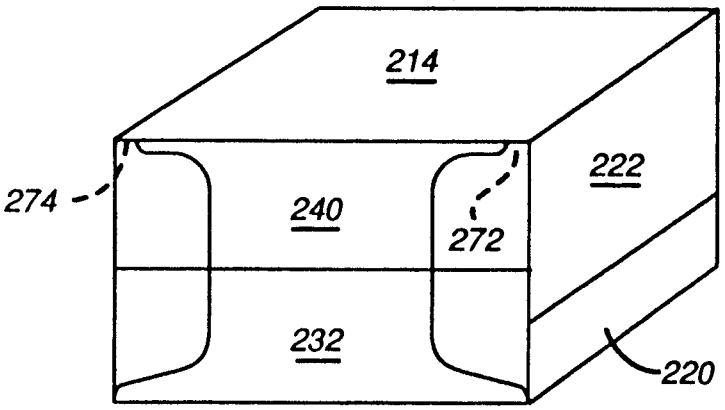
Figure 8:
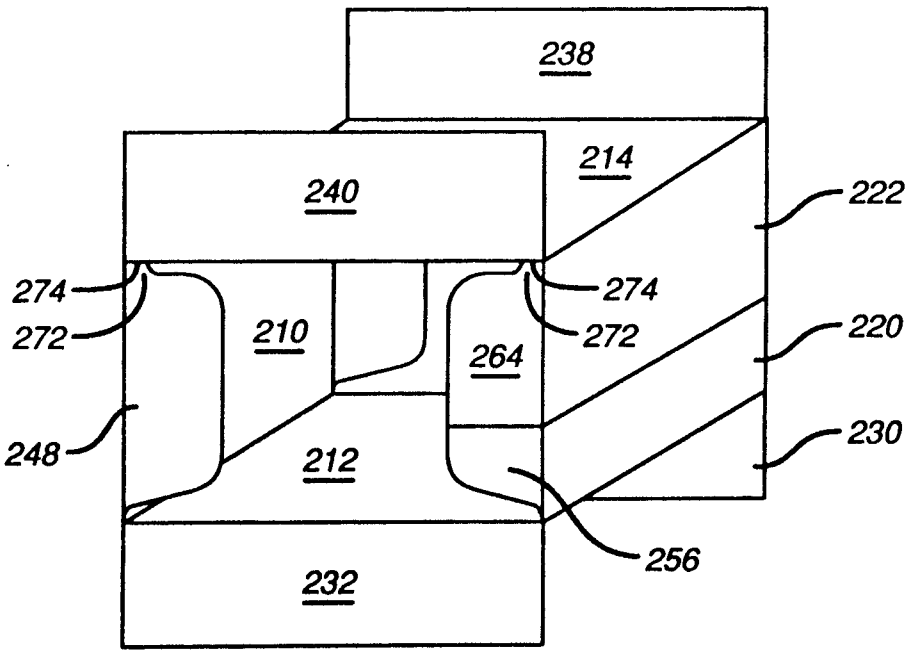

A third alternate embodiment may be seen by reference to FIGS. 7–9. As before, portions of this embodiment which correspond to portions of the embodiment of FIGS. 1–3 are given corresponding reference numerals which have been increased by 200. As with the embodiment of FIGS. 1–3, the embodiment of FIGS. 7–9 does not include web structure between the end flaps and dust flaps. This latter embodiment differs from the embodiment of FIGS. 1–3 in that the alignment projections and alignment edges are formed along the portion of each dust flap closest to the top or bottom wall to which the dust flap is connected. This permits smaller dust flaps to be used, which in certain circumstances may be advantageous from the standpoint of erecting and loading cartons on automatic loading machinery. Referring particularly to FIG. 8, it can be seen that dust flap 248 includes an alignment projection 272 formed at the side edge of dust flap 248 adjacent the fold line 252 connecting dust flap 248 to top wall 210. As before, alignment projection 272 includes an alignment edge 274 disposed adjacent the fold line 244 connecting end flap 240 to side wall 214.

A similar alignment projection 272 is formed on dust flap 256, 264. It should be noted that, unlike the preceding embodiments, only two alignment projections 272 are provided for the end closure structure shown in FIG. 8. It should be recognized that while two such projections 272 are acceptable, it would be possible to include four such projections if desired.

It should also be recognized that further modifications may be made to the tubular beverage cartons disclosed herein within the scope of the invention. For example, the term "dust flaps" has been used herein to refer to that portion of the end closure structure which is folded inwardly first, while the term "end flaps" has been used to refer to that portion of the enclosure structure folded inwardly last. The dust flaps on which the alignment projections are formed need not necessarily be the flaps formed along the shorter dimension of the carton, as shown; the dust flaps and end flaps could be exchanged if the folding sequence of the long and short flaps were reversed.

Similarly, the terms "top wall", "bottom wall", and "side walls" are intended primarily to denote relative position. It is anticipated that during loading, storage, shipment and marketing of the beverage cartons disclosed herein, the cartons may be supported by resting the cartons upon what has been described herein as a "bottom wall" or "side wall". Indeed, the cartons could conceivably be supported by positioning on the "top wall" or the end closure structure. Accordingly, the invention is not intended to be limited by the names applied to the particular carton walls.

What is claimed is:

1. A tubular carton comprising:

a bottom wall having side edges, a pair of side walls foldably joined along fold lines respectively to the side edges of said bottom wall, a top wall having side edges and foldably joined thereto along fold lines respectively to said side walls remote from said bottom wall, said side walls being disposed perpendicular to said top and bottom walls to form a sleeve, a dust flap foldably joined to one end of each of said top and bottom walls and extending to an outer end, an end flap foldably joined to one end of each of said side walls proximate to said dust flaps and extending therefrom a distance less than a width of said top and bottom walls, web structure foldably interconnecting adjacent ones of said dust flaps and said end flaps remote from the outer ends of said dust flaps and said end flaps, at least a major portion of said web structure being taken from said end flaps, each of said dust flaps and said end flaps defining side edges which at outer portions thereof, disposed beyond said web structure, are disposed inwardly from an imaginary line coincidental with the fold line connecting the respective one of said top and bottom walls and said side walls, and an alignment edge defined along the outermost portions of said side edges of each of said dust flaps, each of said alignment edges being defined by a portion of said side edge extending to a respective one of said imaginary lines.

2. A carton according to claim 1, wherein one of said dust flaps is foldably connected to each end of each of said top and bottom walls and wherein one of said end flaps is foldable connected to each end of each of said side walls.

3. A blank for a tubular carton comprising:

a top wall having side edges, a pair of side walls foldably joined along fold lines respectively to the side edges of said top wall, a pair of bottom wall panels having side edges and foldably joined thereto along fold lines respectively to said side walls remote from said top wall, a dust flap foldably joined to one end of each of said top wall and said bottom wall panels and extending to an outer end, an end flap foldably joined to one end of each of said side walls proximate to said dust flaps and extending therefrom a distance less than a width of said top wall, web structure foldably interconnecting adjacent ones of said dust flaps and said end flaps remote from the outer ends of said dust flaps and said end flaps, at least a major portion of said web structure being taken from said end flaps, each of said dust flaps and said end flaps defining side edges which at outer portions thereof disposed beyond said web structure, are disposed inwardly from an imaginary line coincidental with the fold line connecting the respective one of said top wall and said bottom wall panels and said side walls, and an alignment edge defined along the outermost portions of said side edges of each of said dust flaps, each of said alignment edges being defined by a portion of said side edge extending to a respective one of said imaginary lines.

* * * * *